US005300759A

United States Patent [19]

Dodson

[11] Patent Number: 5,300,759

[45] Date of Patent: * Apr. 5, 1994

[54] CONTROL SYSTEM FOR AN APPLIANCE OR THE LIKE, CONTROL DEVICE THEREFOR AND METHODS OF MAKING THE SAME

[75] Inventor: David M. Dodson, Holland, Mich.

[73] Assignee: Robertshaw Controls Company, Richmond, Va.

[ * ] Notice: The portion of the term of this patent subsequent to Mar. 2, 2010 has been disclaimed.

[21] Appl. No.: 882,837

[22] Filed: May 14, 1992

Related U.S. Application Data

[60] Division of Ser. No. 720,914, Jun. 25, 1991, Pat. No. 5,191,190, which is a continuation of Ser. No. 481,889, Feb. 20, 1990, abandoned.

[51] Int. Cl.[5] ..... H05B 1/02

[52] U.S. Cl. ..... 219/506; 219/494; 219/491; 219/487; 338/68

[58] Field of Search ..... 219/505, 506, 491, 497, 219/501, 487, 494; 340/584, 582, 706; 338/68

[56] References Cited

U.S. PATENT DOCUMENTS 3,110,789 11/1963 Hild et al. ..... 200/122
4,695,711 9/1987 McGeorge ..... 219/506
4,755,646 7/1988 Fowler ..... 219/10.55 B
4,843,198 6/1989 Lichtenberger ..... 200/61.86
4,862,917 9/1989 Genbauffe ..... 137/599.2
4,883,983 11/1989 Llewellyn et al. ..... 219/483

*Primary Examiner*—Mark H. Paschall
*Attorney, Agent, or Firm*—Candor, Candor & Tassone

[57] ABSTRACT

A control system, a control device therefor and methods of making the same are provided, the control system comprising a source of energy, an output producing unit that uses the energy to produce the output thereof, a control device having control structure for interconnecting the source of energy to the unit, the control device having a rotatable shaft that sets the control structure in different positions thereof in relation to the rotational set position of the shaft from an "off" position thereof, the control structure having the amount of the energy passing therethrough from the source to the unit being different for each set position thereof, indicating structure operatively associated with the shaft for visually indicating the set position of the shaft and, thus, the amount of energy being fed by the control structure to the unit, and sensing structure operatively associated with the shaft that senses the set position of the shaft and electronically displays that sensed position of the shaft whereby the sensing structure comprises the indicating structure.

6 Claims, 4 Drawing Sheets

CONTROL SYSTEM FOR AN APPLIANCE OR THE LIKE, CONTROL DEVICE THEREFOR AND METHODS OF MAKING THE SAME

CROSS REFERENCE TO RELATED APPLICATION

This application is a divisional patent application of its copending parent patent application, Ser. No. 720,914, filed Jun. 25, 1991, now U.S. Pat. No. 5,191,190 , which in turn, is a continuation patent application of its copending parent patent application, Ser. No. 481,889, filed Feb. 20, 1990, now abandoned.

BACKGROUND OF THE INVENTION

1. Field of the Invention

This invention relates to a new control system for an appliance and to a new control device for such a system, as well as to new methods of making such a system and such a control device.

2. Prior Art Statement

It is known to provide a control system comprising a source of energy, an output producing unit that uses the energy to produce the output thereof, a control device having control means for interconnecting the source of energy to the unit, the control device having a rotatable shaft that sets the control means in different positions thereof in relation to the rotational set position of the shaft from an "off" position thereof, the control means having the amount of the energy passing therethrough from the source to the unit being different for each set position thereof, and indicating means operatively associated with the shaft for visually indicating the set position of the shaft and, thus, the amount of energy being fed by the control means to the unit. For example, see the U.S. Pat. No. to Hild et al, No. 3,110,789, wherein an adjustable cyclable electrical switch means interconnects an electrical power source with a top surface heating element of a cooking apparatus and see the U.S. Pat. No. to Genbauffe, No. 4,862,917, wherein an adjustable valve means interconnects a source of fuel with a top surface burner means of a cooking apparatus.

It is also known to add an electrical switch means to the rotatable shaft of the aforementioned cyclable switch means and valve means to be operated by the rotation of the shaft. For example, respectively see the U.S. Pat. No. to Llewellyn et al, No. 4,883,983, and the U.S. Pat. No. to Lichtenberger, No. 4,843,198.

It is also known to use a rotatable potentiometer to control the power setting of a magnetron of a microwave oven through the rotation of the shaft of the potentiometer, the potentiometer in addition providing means for electronically visually displaying the power output being selected by the shaft of the potentiometer. For example, see the U.S. Pat. No. to Fowler, No., 4,777, 483.

SUMMARY OF THE INVENTION

It is one feature of this invention to provide a new control system for an appliance or the like wherein the same rotatable shaft that is utilized to interconnect a source of energy with an output producing device that uses the energy to produce the output thereof is also utilized to operate an electronic visual display means to indicate the amount of energy passing through the control device to the output producing unit in each set position of the rotatable shaft thereof.

In particular, it is well known that cyclable electrical switch means and gas valve means each have a rotatable shaft which when set in a selected rotational position thereof will feed a certain amount of energy to the output producing unit, such as the amount of power being fed from an electrical power source to a resistive heating element of a cooking apparatus by a cyclable electrical switch means as set forth in the aforementioned U.S. Pat. No. to Hild et al, No, 3,110,789, and such as the amount of fuel being fed from a source of fuel to a burner means of a cooking apparatus through an adjustable valve means as set forth in the aforementioned U.S. Pat. No. to Genbauffe, No. 4,862,917, whereby these two U.S. Pat. Nos. are being incorporated into this disclosure by this reference thereto.

In each of these prior known control devices, a scale is disposed on one of the housing means and the control knob of the control shaft so as to visually indicate from a reference mark on the other of the control knob and the housing means the amount of energy being provided by the particular set position of such rotatable shaft whereby the control knob is considered as being part of the control shaft.

However, it was found according to the teachings of this invention that a sensing means could be operatively associated with the shaft of such a control device, such sensing means being adapted to sense the set position of the shaft and to electronically display that sensed position of the shaft.

In this manner, such an arrangement of this invention can be utilized for a surface heating element means of a cooking apparatus that utilizes either the standard cyclable electrical switch means or the adjustable gas valve means and provide an electronic display of the set positions thereof so as to complement the other electronic display means of the cooking apparatus that is being utilized in connection with the oven control means of that particular cooking apparatus.

Thus, it can be seen that the industry proven cyclable electrical switch means and adjustable gas valve means for the control of the top surface heating elements of a cooking apparatus and the like can still be utilized with the new electronic range controls that are now on the market and that electronically operate the ovens of such cooking apparatus as the display means of this invention to be utilized with such conventional cyclable electrical switch means and adjustable gas valve means will be fully compatible with the electronic appearing aspect of the control panel means of the present cooking apparatus.

For example, one embodiment of this invention provides a control system comprising a source of energy, an output producing unit that uses the energy to produce the output thereof, a control device having control means for interconnecting the source of energy to the unit, the control device having a rotatable shaft that sets the control means in different positions thereof in relation to the rotational set position of the shaft from an "off" position thereof, the control means having the amount of the energy passing therethrough from the source to the unit being different for each set position thereof, indicating means operatively associated with the shaft for visually indicating the set position of the shaft and, thus, the amount of energy being fed by the control means to the unit, and sensing means operatively associated with the shaft that senses the set position of the shaft and electronically displays that sensed position of the shaft whereby the sensing means comprises the indicating means.

Another embodiment of this invention provides a control device for interconnecting a source of energy with an output producing unit that uses the energy to produce the output thereof, the control device comprising control means for interconnecting the source of energy to the unit, the control device having a rotatable shaft that sets the control means in different positions thereof in relation to the rotational set position of the shaft from an "off" position thereof, the control means being adapted to have the amount of the energy passing therethrough from the source to the unit being different for each set position thereof, indicating means operatively associated with the shaft for visually indicating the set position of the shaft and, thus, the amount of energy being fed by the control means to the unit, and sensing means operatively associated with the shaft that senses the set position of the shaft and electronically displays that sensed position of the shaft whereby the sensing means comprises the indicating means.

Accordingly, it is an object of this invention to provide a new control system having one or more of the novel features of this invention as set forth above or hereinafter shown or described.

Another object of this invention is to provide a new method of making such a control system, the method of this invention having one or more of the novel features of this invention as set forth above or hereinafter shown or described.

Another object of this invention is to provide a new control device for interconnecting a source of energy with an output producing unit that uses the energy to produce an output thereof, the control device of this invention having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
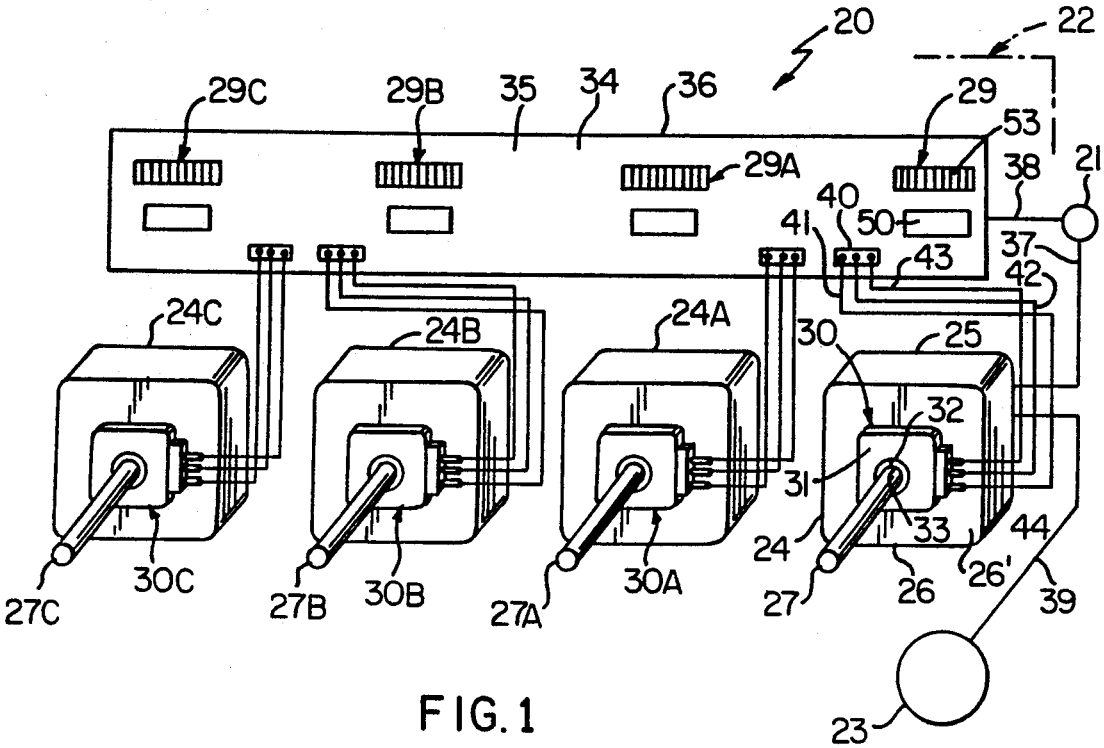
FIG. 1 is a schematic view that is partially in perspective and that illustrates a control system of this invention.

While the various features of this invention are hereinafter illustrated and described as being particularly adapted to provide a control system and a control device for a cooking apparatus, it is to be understood that the various features of this invention can be utilized singly or in various combinations thereof to provide a control system and a control device for other types of appliances as desired.

Therefore, this invention is not to be limited to only the embodiment illustrated in the drawings, because the drawings are merely utilized to illustrate one of a wide variety of uses of this invention.

Referring now to FIG. 1, a new control system of this invention is generally indicated by the reference numeral 20 and comprises a source of energy 21, which in the embodiment of FIG. 1 is a conventional electrical power source of 120 VAC or 220 VAC for a home or building that has a cooking apparatus therein that is generally indicated by the reference numeral 22 in FIG. 1 and utilizing the system 20 of this invention for controlling the operation thereof, the system 20 also comprising an output producing unit 23 that uses the energy from the source 21 to produce the output thereof and in the embodiment of the system 20 of FIG. 1, the output producing unit 23 comprises an electrically operated top surface cooking element of the cooking apparatus 22.

The control system 20 of this invention also comprises a control device 24 having control means 25 for interconnecting the source of energy 21 to the unit 23, the control device 24 in the embodiment of the control system 20 illustrated in FIG. 1 comprising a cyclable electrical switch means of the type fully described in the aforementioned U.S. Pat. No. to Hild et al, No, 3,110,789, which has been incorporated herein by the previous reference thereto so that the details of such cyclable switch means need not be set forth as the details of the structure and operation thereof are well known in the art. Therefore, for the purpose of understanding the features of this invention, it is only necessary to state that the control device 24 includes a housing means 26 having a cyclable switch means therein that comprises the control means 25 and can have the duty cycle thereof changed or set by a rotatable shaft 27 that projects out of a front side 26' of the housing means 26 and is interconnected to a suitable control knob, such as control knob 28, FIG. 3, for rotating the shaft 27 whereby the knob 28 comprises part of the control shaft 27 of the control device 24.

Thus, it can be seen that the operator of the cooking apparatus 22 can control the amount of energy being passed through the control device 24 from the source 21 to the unit 23 by setting the rotatable shaft 27 to a desired rotational position thereof, the operator of the system 20 being adapted to visually determine the set rotational position of the shaft 27 of the control device 24 by viewing an indicating means of this invention that is generally indicated by the reference numeral 29 in FIG. 1.

Figure 8:
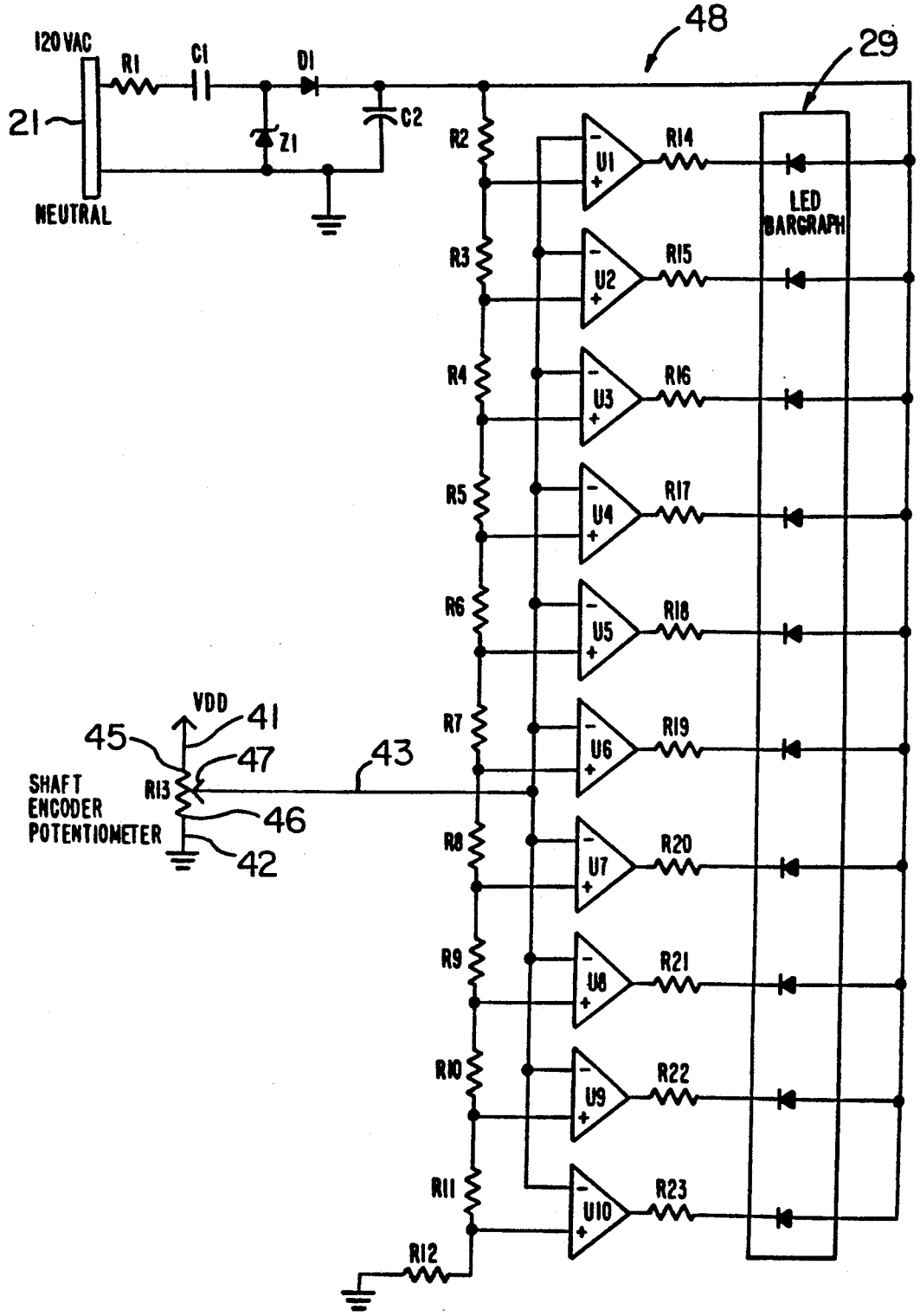
FIG. 8 illustrates the electrical circuit of the system of FIG. 1 for one of the control units thereof.

The indicating means 29 in the embodiment of the control system 20 of this invention illustrated in FIG. 1 comprises an electronic display that is commonly known as an LED bar graph and forming part of a sensing means of this invention that is generally indicated by the reference numeral 30 in FIG. 1, the sensing means 30 in the embodiment illustrated in FIG. 1 comprising a conventional ratiometric potentiometer that has a housing means 31 and a rotatable actuator 32 which when rotated relative to the housing means 31 has a wiper 47, FIG. 8, moved across a resistance R13, FIG. 8, in a conventional manner to produce an output signal that is linear with respect to the rotational position of the actuator 32 from an "off" or "home" position thereof as is well known in the art.

Therefore, since electrically operated potentiometers are well known in the art, a further discussion of the structure and operation of the potentiometer 30 need not be set forth. For example, see the aforementioned U.S. Pat. No. to Fowler, No. 4,777,483, which discloses the use of a potentiometer to directly control the power output of the magnetron of a microwave oven whereby such U.S. patent is being incorporated into this disclosure by this reference thereto.

However, in one working embodiment of the control system 20 of this invention, the potentiometer 30 comprises a potentiometer that is sold by the Bourne Controls Company of Ogden, Utah, as Model No. EC00 wherein the housing 31 thereof defines substantially a square having a side length of approximately 0.78 of an inch and being approximately 0.260 of an inch thick.

The actuator 32 of the potentiometer 30 has an opening 33 passing completely therethrough and, thus, through the housing 31 so that the shaft 27 of the control device 24 can pass through the opening 33 of the potentiometer 30 and be splined thereto in any conventional manner, such as by having the shaft 27 and the opening 33 each being D-shaped in a transverse cross-sectional direction, so that rotation of the shaft 27 will cause like rotation of the actuator 32 of the potentiometer 30. Thus, the housing 31 of the potentiometer 30 can be secured to the side 26' of the housing 26 of the control device 24 so that the housings 31 and 26 remain stationary while the shaft 27 can be rotated thereto and simultaneously adjust the control means 25 of the cyclable switch means 24 and the rotational position of the actuator 32 of the potentiometer 30.

The display 29 of the sensing means 30 is provided on a printed circuit board 34 that has opposed flat sides 35 and 36 in a conventional manner.

The power supply 21 is interconnected to the control device 24 by lead means 37 and is interconnected to the circuit board means 34 by lead means 38, the control means 25 of the control device 24 being interconnected to the unit 23 by a lead means 39.

The circuit board 34 has a header 40 that interconnects three leads 41, 42 and 43 with a header 44 of the potentiometer 30 whereby the lead 41 interconnects a voltage source VDD, FIG. 8, to one side 45 of the resistive element R13 of the potentiometer 30 while the lead 42 interconnects the other side 46 of the resistive element R13 to ground. The lead 43 in turn interconnects the wiper 47, FIG. 8, that is moved by the actuator 32 of the potentiometer 30 across the resistance R13 in a manner well known in the art to a circuit means that is generally indicated by the reference numeral 48 in FIG. 8 that controls the bar graph display 29 in a manner hereinafter set forth.

Figure 7:
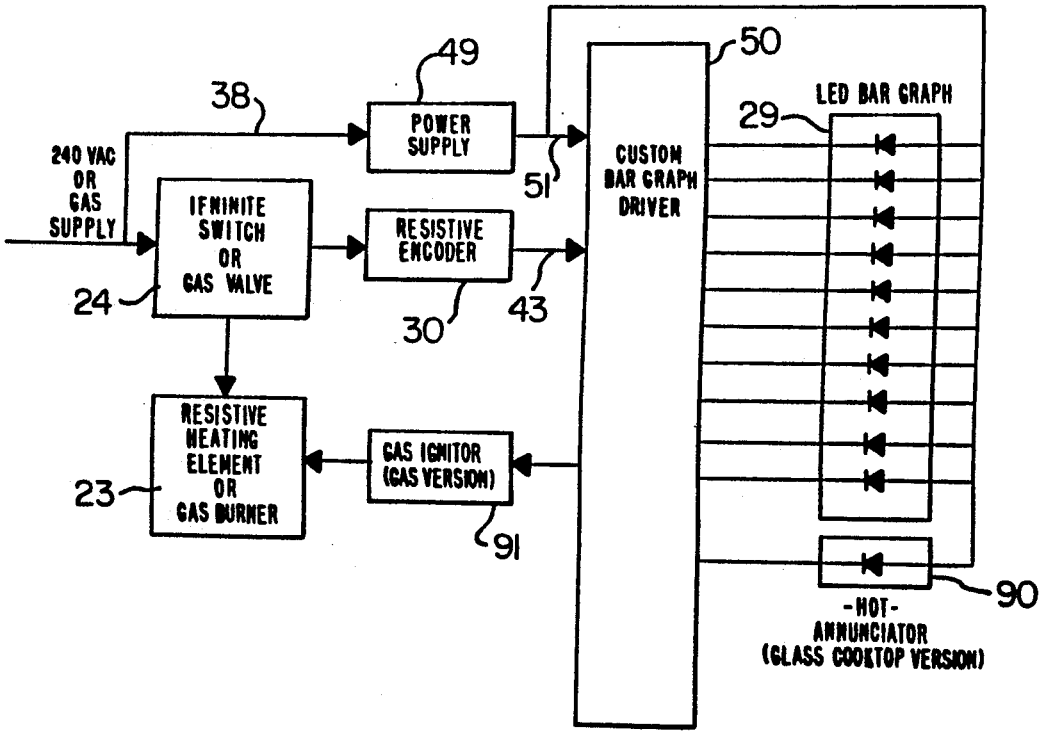
FIG. 7 is a block diagram of the basic components of one of the four control units of the system of FIG. 1.

As illustrated by the block diagram illustrated in FIG. 7, the lead 38 that interconnects the power source 21 to the printed circuit board 34 has a power supply means 49 therein to convert the supply voltage to approximately 10 volts DC with the power supply 49 thereafter interconnecting that 10 volt DC to a custom bar graph driver 50 by a lead means 51 and to the LED bar graph display 29 by a lead means 51.

The block diagram of FIG. 7 also illustrates the potentiometer 30 having the wiper lead 43 interconnecting to the custom bar graph driver 50.

While the output from the potentiometer 30 can control the bar graph display 29 in any suitable manner, the electrical circuit 48 of FIG. 8 comprises one working embodiment of this invention for operating the bar graph display 29, the LED bar graph display 29 being a series of individual LED segments 53 for displaying power output in a conventional manner.

The electrical circuit 48 of FIG. 8 uses a series of comparators U1–U10 to drive the LED bar graph display 29. The power supply 49 converts the power source 21 from the 120 VAC or 240 VAC thereof to approximately 10 volts DC for the bar graph driver 50 and the LED segments 53. The circuit 48 uses a series combination of resistance R1 and capacitance C1 to impede the AC current flow into the circuit 48, the zener diode Z1 limiting the voltage to 10 volts DC. A diode D1 rectifies the voltage to a net positive DC level and a capacitor C2 filters the ripple voltage resulting in the 10 volt DC supply.

The potentiometer 30, through rotation of the shaft 7, has the resistance R13 thereof provide a resistance change versus angular rotation of the control shaft 27 and this resistance change is a ratio of the full 10 volt DC power supply. This ratiometric signal is fed by the lead 43 into the inverting terminals of the ten comparators U1–U10 as illustrated in FIG. 8. The non-inverting terminal of each comparator U1–U10 has a different voltage ratio determined by the resistors R2-R12 interconnected as shown in FIG. 8. If the incoming voltage from the resistance R13 of the shaft encoder potentiometer 30 is greater than the non-inverting terminal voltage, the comparator section output will switch to the low voltage state. A low voltage state allows current to flow from the particular LED bar graph segment 53 to ground through the comparator output thereof. Resistors R14 and R23 limit the current flowing through the LED diodes in the bar graph display 29 as illustrated in FIGS. 7 and 8.

Thus, it can be seen that the segments 53 of the display 29 will light up in a series manner from left to right the greater the amount of rotational movement of the shaft 27 from its "off" position toward its full "on" position for delivering maximum power to the unit 23, such full "on" power position causing all ten segments 53 of the bar graph display 29 to be activated by the circuit 48.

Thus, it can be seen that it is a relatively simple method of this invention to make the control system 20 and the control device 24 of this invention that operates in a manner now to be described.

When the control shaft 27 of the control device 24 is disposed in its "off" condition, the control means 25 of the control device 24 prevents any electrical current from the power source 21 from reaching the output producing unit or element 23 and, in such position of the control shaft 27, the potentiometer 30 has the wiper 47 positioned by the actuator 32 relative to the resistance R13 so that none of the segments 53 of the LED bar graph display 29 are activated or lit and thereby visually indicating to the operator that the surface heating element 23 is in an "off" condition thereof.

However, when the operator desires to utilize the particular surface heating element 23, the operator rotates the shaft 27 in the "on" direction thereof from the "off" position thereof and as the shaft 27 rotates, the control means 25 of the control device 24 is adjusted so as to provide a certain amount of energy from the source 21 to the unit 23 to cause the same to produce heat and the particular position of the shaft 27 is sensed by the position of the wiper 47 on the resistance R13 so that a certain number of the segments 53 of the display 29 in series from the left to the right are operated or lit and additional segments 53 in series therewith will likewise be operated or lit as the control shaft 27 is further rotated in a direction toward the full "on" position thereof so that the operator can determine exactly what amount of energy he wants the output unit 23 to provide. For example, a low heating effect would be provided by only one or two of the segments 53 of the bar graph 28 being operated and a more conventional heating output effect would be provided by approximately five of the segments 53 from the left toward the right being operated and when full heating power is desired, all ten segments 53 will be operated and the control shaft 27 will be in its full "on" position.

Thus, the control device 24 will maintain the output heating effect of the surface unit 23 at the output selected by the particular rotational position of the control shaft 27 as visually indicated by the display 29 having been operated in the manner previously set forth.

Thereafter, when the operator desires to discontinue the operation of the heating element 23, the operator rotates the shaft 27 back to its "off" position wherein the control means 25 of the control device 24 disconnects the power source 21 from the heating element 23 and the potentiometer 30 is in such a position that the wiper 47 prevents any of the segments 53 of the LED bar graph 29 to be operated.

While the operation previously set forth has been described in connection with the right hand control device 24 illustrated in FIG. 1, it is to be understood that the system 20 would have a like control device arrangement for each of the surface elements of a cooking apparatus and that the operation of each of those control devices would be identical to the operation of the control device 24 as previously set forth.

Therefore, it can be seen that the system 20 illustrated in FIG. 1 has four such control devices with the other control devices being respectively indicated by like reference numerals followed by the reference letters "A", "B" and "C" and each having associated with the control shaft 27A, 27B and 27C thereof a potentiometer 30A, 30B and 30C and its respective electronic display 29A, 29B and 29C.

Figure 3:
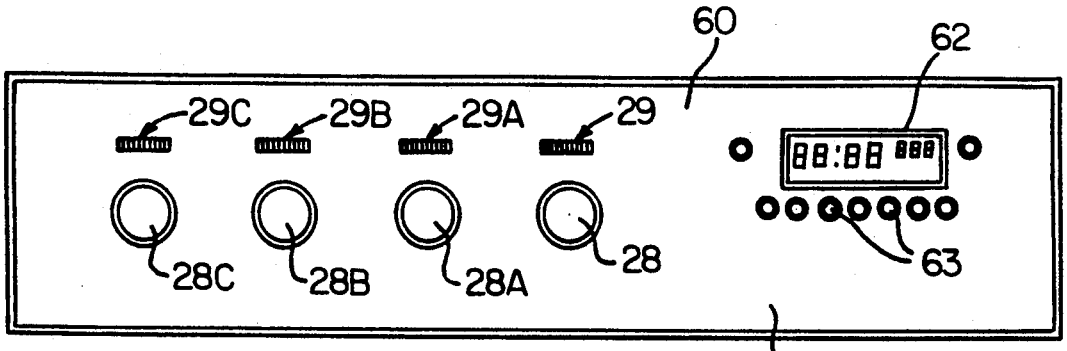
FIG. 3 is a front view of a control panel of a cooking apparatus utilizing the system of FIG. 1.

The system 20 illustrated in FIG. 1 can be utilized to provide a control panel 60, FIG. 3, for the cooking apparatus 22, the panel 60 having the bar graph displays 29, 29A, 29B and 29C viewable from the front 61 thereof and the control shafts 27-27C respectively have control knobs 28, 28A, 28B and 28C interconnected thereto and being adapted to be grasped and rotated by an operator facing the front 61 of the control panel 60.

In addition, the control panel 60 has another electronic display 62 viewable at the front 61 thereof and having control buttons or knobs 63 for controlling the operation of the oven of the cooking apparatus 22 in a manner similar to the range control set forth in the U.S. Pat. No. to Kadwell et al, No. 4,782,215, whereby this U.S. patent is being incorporated into this disclosure by this reference thereto.

Thus, it can be seen that the control panel 60 of 5 FIG. 3 for the cooking apparatus 22 has the display means 29-29C for four top surface cooking elements respectively controlled by the control knobs 28-28C and being electronic display means that are compatible with the electronic display means 62 that is provided by the range control means for the oven of the cooking apparatus 20.

While the system 20 illustrated in FIG. 1 has the control devices 24A disposed remote from the circuit board 34, it is to be understood that the control devices 24A could be mounted directly to the circuit board 34 if desired.

Figure 2:
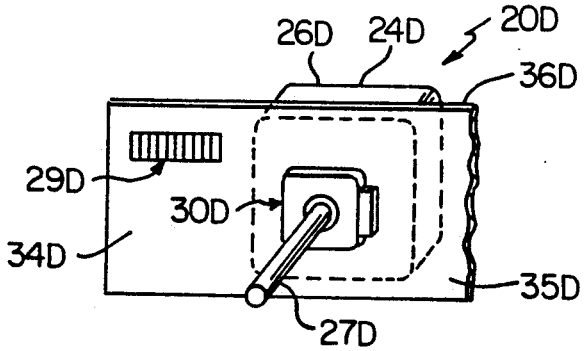
FIG. 2 is a fragmentary perspective view of another control system of this invention.

For example, another control system of this invention is generally indicated by the reference numeral 20D in FIG. 2 and parts of the system 20D that are similar to like parts of the system 20 previously described are indicated by like reference numerals followed by the reference letter "D".

As illustrated in FIG. 2, it can be seen that the circuit board 34D has a suitable opening (not shown) formed therethrough which will permit the control shaft 27D to pass therethrough and rotate therein so that the control device 24D can have its housing 26D secured to the side 36D of the circuit board 34D and the potentiometer 30D can be disposed and secured against the front side 35D of the circuit board 34D as illustrated so that the shaft 27D can still project out from the front 35D of the circuit board 34D and simultaneously operate the potentiometer 30D and control device 24D in the manner previously set forth. In this manner, the arrangement illustrated in FIG. 2 can readily provide the control panel 60 of FIG. 3 wherein the printed circuit board 34D is disposed directly behind the control panel 60 and not only carries the display means 29D thereon, but also carries the control devices 24D and their associated potentiometers 30D thereon to operate in the manner previously set forth.

While the control panel 60 includes an oven range control therewith, it is to be understood that the control system 20 of this invention can be utilized with just a cooking top cooking apparatus arrangement, if desired.

Figure 4:
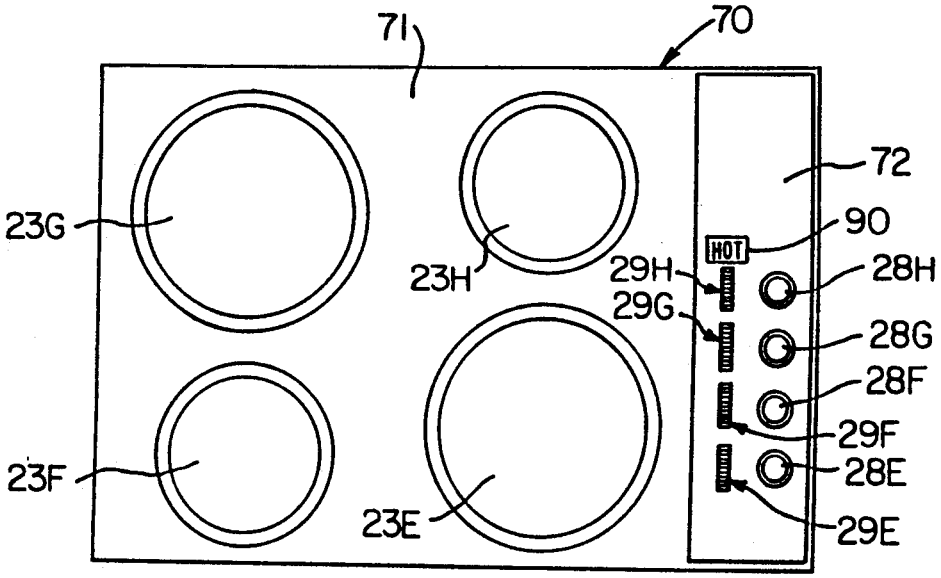
FIG. 4 is a top view of a cook top cooking apparatus and utilizing the system of FIG. 1.

For example, reference is now made to FIG. 4 wherein it can be seen that a range top cooking apparatus is generally indicated by the reference numeral 70 and comprises a top surface 71 having four top surface elements 23E, 23F, 23G and 23H respectively controlled by control knobs 28E, 28F, 8G and 28H that project out of a control panel means 72 that includes the respective display means 29E, 29F, 29G and 29H.

Thus, it is to be understood that the system 20 of this invention can be used with any desired control panel arrangement and not with just the control panel arrangements previously described.

While the control system 20 of this invention has been previously described as providing electrical current to an electrically operated surface element, it is to be understood that the control system of this invention can utilize as the control device thereof an adjustable gas valve means that supplies fuel from a fuel source to a gas burner that comprises the surface element means of a cooking apparatus.

Figure 5:
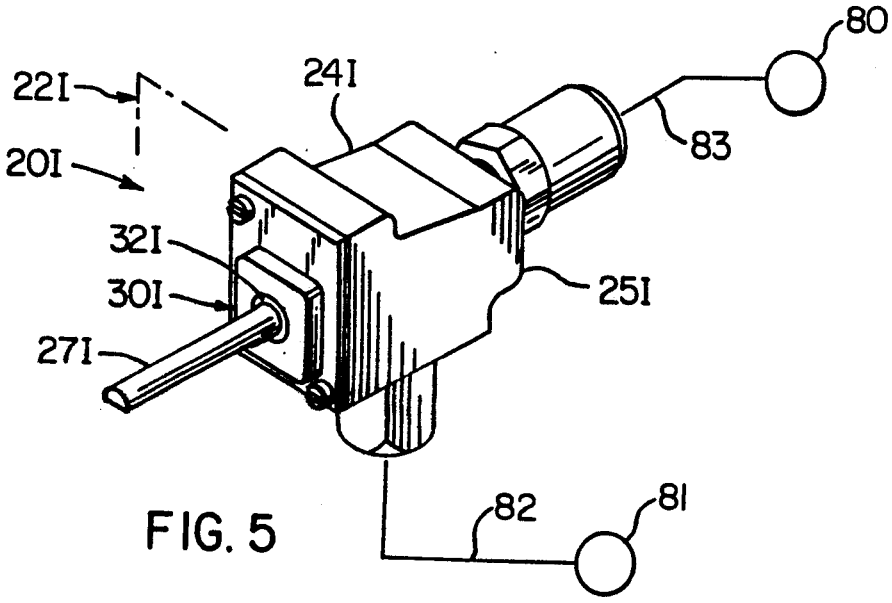
FIG. 5 is a fragmentary perspective view that schematically illustrates another control system of this invention.

For example, reference is now made to FIG. 5 wherein another control system of this invention is generally indicated by the reference numeral 20I and parts thereof similar to the system 20 previously described are indicated by like reference numerals followed by the reference "I".

As illustrated in FIG. 5, the system 20I is provided for a cooking apparatus 22I that comprises a gas range having a plurality of top surface elements that comprise gas burner means, such as the gas burner means 80 illustrated in FIG. 5 that is adapted to be interconnected to a gas fuel source 81 by a control device 24I that comprises a gas valve that has the amount of opening of a valve structure thereof controlled by the rotational position of the control shaft 27I so that the control means 25I of the device 24I comprises the valve structure thereof that changes the amount of fuel that is adapted to pass from the source 81 and the inlet conduit means 82 to the device 24I out through an outlet conduit 83 to the burner means 80 in relation to the rotational position of the shaft 27I in a conventional manner. For example, see the aforementioned U.S. Pat. No. to Genbauffe, No. 4,862,917, whereby this patent is being incorporated into this disclosure by this reference thereto.

A potentiometer 30I is mounted to the control device 24I in the same manner that the potentiometer 30 was mounted to the device 24 previously described so that the control shaft 27I will operate the actuator 32I of the potentiometer 30I to indicate the rotational position of the control shaft 27I in the manner previously described for the potentiometer 30.

Since the operation of the control system 20I is substantially identical to the control system 20 previously set forth, the operation of the control system 20I will not be set forth except to state that it can be seen that the system 20 has a gaseous fuel source instead of an electrical energy source for a top surface element of a cooking apparatus.

Figure 6:
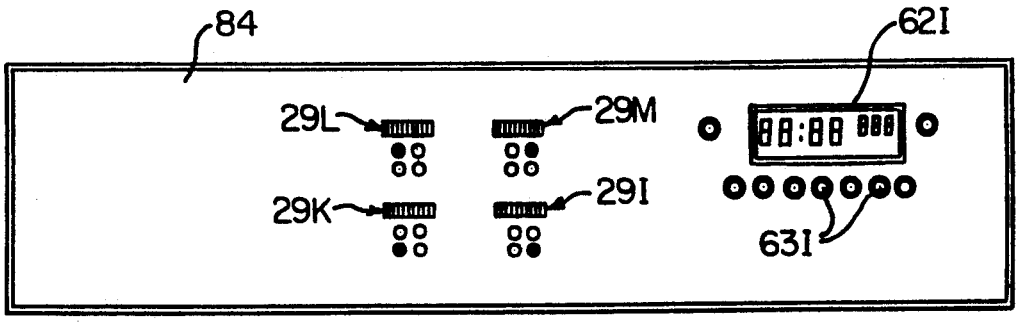
FIG. 6 is a front view of a control panel of a cooking apparatus utilizing the system of FIG. 5.

The cooking apparatus 22I can comprise four control devices 20I which respectively have the potentiometers 30I thereof operate electronic display means 29I, 29K, 29L and 29M as provided in a control panel 84 illustrated in FIG. 6 which also includes an electronic display 62I for controlling the cooking apparatus 22I, if desired Therefore, it can be seen that the control panel 84 for the cooking apparatus 22I provides electronic display means for the top burner means thereof so as to be compatible with the electronic display 62I for the oven thereof in the same manner as provided by the control panel 60 for an electrically operated cooking apparatus.

Therefore, it can be seen that in each of the systems of this invention, a custom rotary potentiometer changes its resistance with the rotation of the control shaft of an infinite switch or a gas control and as the shaft of the infinite switch or the gas control is turned, the potentiometer senses the rotation and an LED bar graph displays the output whereby the system has the advantage of bright electronic visual feedback in combination with the proven reliability of a rotary infinite switch or a rotary gas control each of which is believed to be less costly than its fully electronic equivalent.

The rotary potentiometer is, in effect, a resistive encoder that can be tooled to fit the particular gas valve or infinite switch shaft so that the resistive encoder senses the degree of shaft rotation which is proportional to the infinite switch or gas control power output. The custom bar graph driver of this invention takes the input from the resistive encoder and drives the corresponding number of LEDs in the LED bar graph display. However, it is to be understood that the custom bar graph driver could be a semicustom IC or a microcomputer with an A/D convertor. In addition, the LED bar graph could be replaced by a vacuum fluorescent bar graph or a 7-segment display, if desired.

Also, specialty functions could be implemented into the IC. For example, a "hot" glass cook top annunciator and/or a gas ignitor output can be provided.

In particular, it can be seen in FIG. 7 that a "hot" annunciator 90 is provided in the block diagram and can be added for glass cook top purposes so that for a fixed period of time after the control device 20I was turned to its "off" position, the "hot" annunciator 90 as illustrated on the control panel 72 of FIG. 4 would remain on so that the consumer would not touch the hot glass until the indicator 90 would return to a non-acutated "off" condition thereof.

In addition, rotation of the shaft 27I of a control device 24I could operate a relay or opto-triac output when the control shaft reaches a "light" position thereof so as to provide ignition for its respective top burner 80 for a purpose well known in the art. For example, a gas ignitor is usually a spark control that is supervised or unsupervised. The potentiometer 30I of this invention can sense when the gas valve is in the light position thereof and thereby drive the ignition system as previously set forth, such gas ignition means being represented by the block 91 in FIG. 7.

Of course, many other embodiments can also be provided, such as a cooking probe for a temperature display of the food, an integrated timer for timing applications, etc.

Therefore, it can be seen that this invention not only provides a new control system and a new control device for such a system or the like, but also this invention provides new methods of making such a control system and such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control system comprising a source of gas fuel energy, an output producing heating unit that uses said energy to produce said output thereof, a control device having control means that comprises an infinitely variable valve means for interconnecting said source of energy to said unit, said control device having a rotatable shaft provided with opposed ends of which one of said opposed ends is mechanically interconnected to said valve means and of which the other of said opposed ends is interconnected to a control knob that sets said valve means in different positions thereof in relation to the rotational set position of said shaft from an "off" position thereof by rotation of said control knob, said valve means having the amount of said energy passing therethrough from said source to said unit being different for each set position thereof, and indicating means operatively associated with said shaft for visually indicating the set position of said shaft and, thus, the amount of energy being fed by said valve means to said unit, the improvement comprising sensing means operatively associated with said shaft that senses the set position of said shaft and electronically displays that sensed position of said shaft whereby said sensing means comprises said indicating means, said sensing means comprising a potentiometer having a housing means and a movable actuator carried thereby, said actuator having an opening passing therethrough, said shaft having an intermediate part thereof telescopically disposed in said opening of said actuator and being splined thereto whereby said shaft carries said potentiometer and said valve means in coaxially aligned relation so that rotation of said shaft by said control knob mechanically rotates said actuator therewith at the same time said shaft is mechanically setting said valve means.

2. A control system as set forth in claim 1 wherein said heating unit comprises a surface element of a cooking apparatus.

3. A control system as set forth in claim 1 wherein said sensing means comprises a printed circuit board means having opposed sides and an opening passing through said sides, said potentiometer being carried on one of said sides of said board and said control device being carried on the other of said sides of said board and having said shaft passing through said opening to interconnect with said potentiometer.

4. In a control device for interconnecting a source of gas fuel energy with an output producing heating unit that uses said energy to produce said output thereof, said control device having control means that comprises an infinitely variable valve means for interconnecting said source of energy to said unit, said control device having a rotatable shaft provided with opposed ends of which one of said opposed ends is mechanically interconnected to valve means and of which the other of said opposed ends is interconnected to a control knob that sets said valve means in different positions thereof in relation to the rotational set position of said shaft from an "off" position thereof by rotation of said control knob, said valve means being adapted to have the amount of said energy passing therethrough from said source to said unit being different for each set position thereof, and indicating means operatively associated with said shaft for visually indicating the set position of said shaft and, thus, the amount of energy being fed by said valve means to said unit, the improvement comprising sensing means operatively associated with said shaft that senses the set position of said shaft and electronically displays that sensed position of said shaft whereby said sensing means comprises said indicating means, said sensing means comprising a potentiometer having a housing means and a movable actuator carried thereby, said actuator having an opening passing therethrough, said shaft having an intermediate part thereof telescopically disposed in said opening of said actuator and being splined thereto whereby said shaft carries said potentiometer and said valve means in coaxially aligned relation so that rotation of said shaft by said control knob mechanically rotates said actuator therewith at the same time said shaft is mechanically setting said valve means.

5. A control device as set forth in claim 4 wherein said heating unit comprises a surface element of a cooking apparatus.

6. A control device as set forth in claim 4 wherein said sensing means comprises a printed circuit board means having opposed sides and an opening passing through said sides, said potentiometer being carried on one of said sides of said board and said control device being carried on the other of said sides of said board and having said shaft passing through said opening to interconnect with said potentiometer.

* * * * *